United States Patent [19]

Litwinchuk et al.

[11] Patent Number: 4,807,575

[45] Date of Patent: Feb. 28, 1989

[54] HYDRAULIC LASH ADJUSTER WITH MULTI-DIRECTIONAL CHECK VALVE

[75] Inventors: Alexander Litwinchuk, Jenison; Lowell E. Dura, Ada; Adrian Dekker, Grandville, all of Mich.

[73] Assignee: General Motors Corporation, Detroit, Mich.

[21] Appl. No.: 124,160

[22] Filed: Nov. 23, 1987

[51] Int. Cl.[4] ..... F01L 1/24

[52] U.S. Cl. ..... 123/90.55

[58] Field of Search ..... 123/90.43, 90.46, 90.55, 123/90.56, 90.57, 90.58, 90.59

[56] References Cited

U.S. PATENT DOCUMENTS

| | | | |
|---|---|---|---|
| 1,062,580 | 5/1913 | Bollee | 123/90.59 |
| 2,220,336 | 11/1940 | Johnson et al. | 123/90.55 |
| 3,421,609 | 11/1975 | Rhoads | 123/90.55 |
| 3,728,990 | 4/1973 | Lampredi et al. | 123/90.56 |
| 4,054,109 | 10/1977 | Herrin et al. | 123/90.55 X |
| 4,223,648 | 9/1980 | Pozniak et al. | 123/90.16 |
| 4,361,120 | 11/1982 | Kueny | 123/90.55 |
| 4,584,976 | 4/1986 | Hillebrand | 123/90.55 |

*Primary Examiner*—Willis R. Wolfe

*Attorney, Agent, or Firm*—R. J. Outland

[57] ABSTRACT

In a hydraulic lash adjuster, a flat reed valve is used to control oil flow from a reservoir chamber to a pressure chamber, the reed valve including a semi-circular flapper flexibly connected by a spring leg to a split retainer ring.

2 Claims, 1 Drawing Sheet

HYDRAULIC LASH ADJUSTER WITH MULTI-DIRECTIONAL CHECK VALVE

FIELD OF THE INVENTION

This invention relates to hydraulic lash adjusters such as are used, for example, in maintaining substantially zero lash in the valve operating mechanisms of internal combustion engines and, in particular, to such a hydraulic lash adjuster having an improved check valve therein.

DESCRIPTION OF THE PRIOR ART

Hydraulic lash adjusters used either as lifters or tappets, in rocker arms, as pivots for rocker arms or an elements in overhead cam valve lifters are well known. In the better known and more widely used hydraulic lash adjusters of the type disclosed for example in U. S. Pat. Nos. 2,840,063 Purchase, Jr. and 3,139,078 Van-Slooten, a plunger is slidably received in a cup-shaped cylinder member so as to form with the closed end of the cylinder member a pressure chamber. Flow of hydraulic fluid through the plunger into the pressure chamber is controlled by a one-way check valve that is normally in the form of a ball, although spring blades and simple circular disk have also been proposed for use as the one-way check valve in various patents. Whether the one-way check valve is in form of a ball or disks, it has been the normal practice, although not always necessary, to have a valves return spring associated with the valve to insure of only one-way flow of the fluid.

In such a lash adjuster it has also been conventional to use a check valve retainer or cage to limit opening travel of the check valve and to use a plunger spring located in the pressure chamber to normally bias the plunger in an axially outward direction relative to the cylinder member.

SUMMARY OF THE INVENTION

The present invention relates to hydraulic lash adjuster element assemblies of the type having a tubular plunger slidable in a cup-shaped cylinder member so as to form with the closed end of the cylinder member a pressure chamber supplied through an axial port in the plunger with hydraulic fluid as controlled by a multi-directional, flat check valve.

It is therefore a primary object of this invention to provide an improved check valve, in the form of a flat reed valve, for use in a hydraulic lash adjuster element assembly.

For a better understanding of the invention as well as other objects and further features thereof, reference is had to the following detailed description of the invention to be read in connection with the accompanying drawings.

DESCRIPTION OF THE PREFERRED EMBODIMENT

Figure 1:
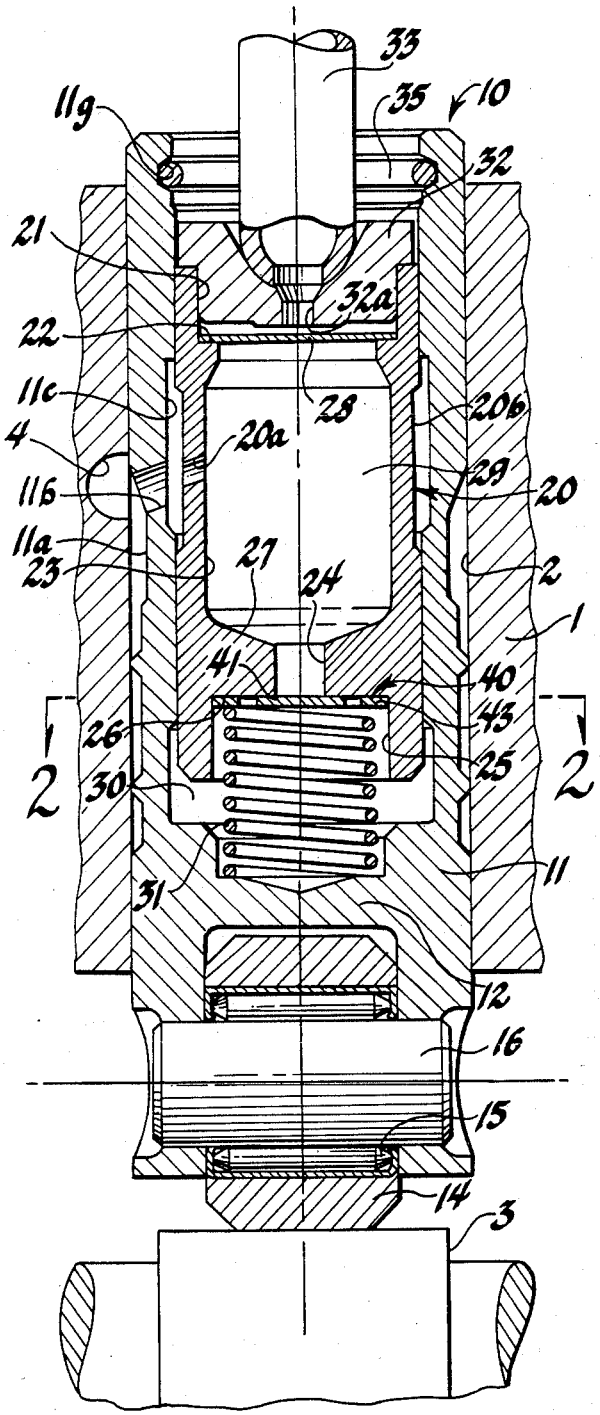
FIG. 1 is a longitudinal cross-sectional view of a roller follower type hydraulic lash adjuster having a flat reed valve in accordance with the invention incorporated therein; and, FIG. 2 is a top view of the flat reed valve, per se, of FIG. 1.

For purpose of illustration and by way of an example only there is shown in FIG. 1 a roller type hydraulic valve lifter 10 having a reed check valve in accordance with the invention incorporated therein. As shown, the roller hydraulic valve lifter 10 is slidably received in a lifter bore 2 provided in a crank case or other fixed part 1 of an engine so as to be actuated by an engine driven cam 3. An oil gallery 4 in part 1 is used to supply hydraulic fluid, such as engine oil from an engine driven pump, not shown, in a conventional manner to the roller hydraulic valve lifter 10.

The roller hydraulic valve lifter 10 includes a cup-shaped cylinder member 11 which as its lower closed end is bifurcated as at 12 so as to loosely receive a roller cam follower 14 rotatably journaled by needle bearings 15 on a stub shaft 16 suitably fixed to the bifurcated 12 portion of the cylinder member 11.

A plunger 20 has a suitable external peripheral surface so as to be in close sliding fit for reciprocation within the cylinder member 11 to retain a volume of fluid therebetween in a manner and for a purpose well known in the art. Plunger 20 is provided with a stepped bore therethrough so as to define, in succession starting from the top, a cylindrical inner upper wall 21, an internal shoulder 22, an intermediate wall 23, a wall defining a port 24 and a lower wall 25, which in the construction shown is of approximately the same diameter as intermediate wall 23. Wall 25 is connected to port wall 24 by a flat shoulder 26 defining a valve seat and port wall 24 and intermediate wall 23 are also interconnected by a shoulder 27.

Walls 21 and 23, as shown, are of greater internal diameter than the effective diameter of the internal shoulder 22 so that this shoulder 22 serves as an abutment shoulder for a circular valve disk 28. Intermediate wall 23 and shoulder 27 define in part a reservoir chamber 29. Lower wall 25 is inclined starting from its lower free end radially inward at a slight angle of, for example, approximately 1° for a purpose to be described in detail hereinafter.

The plunger 20 forms with the closed end of the cylinder member 11 a pressure chamber 30 which is supplied with hydraulic fluid from the reservoir chamber 29 via port 24 with flow through the port 24 being controlled by a flat one way check valve in the form of a flat reed valve 40 in accordance with the invention to be described in detail hereinafter.

The flat reed valve 40 is operatively positioned so as to abut against the valve seat flat shoulder 26 by a plunger spring 31 loosely received in the pressure chamber 30.

Mounted in the upper open end of the plunger 20 is a conventional push rod seat member 32 for a hollow push rod 33. A central outlet port **32*a* in the push rod seat member 32 is provided to accommodate flow of fluid from the reservoir chamber 29 to the interior of the push rod 33 with flow thereto controlled by the valve disk 28**.

As is conventional, a split ring retainer 35 positioned in a suitable annular groove **11*g* provided for this purpose in the cylinder member 11 is used to hold the push rod seat member 32 and plunger 20 and elements associated therewith in unit assembly within the cylinder member 11**.

Hydraulic fluid is supplied to the reservoir chamber 29 via an annular groove **11*a* on the exterior of the cylinder member 11 that is of a sufficient axial extent to communicate at all times with the oil gallery 4 and at least one through connecting port 11***b* in the cylinder member 11.

Registering passage means are also provided for connecting the reservoir chamber 29 to the cylinder port 11*b*, as by a plunger port 20*a* in the plunger 20 and in the construction shown by annular grooves 20*b* and 11*c* provided in the plunger 20 and cylinder member 11, respectively.

Figure 2:
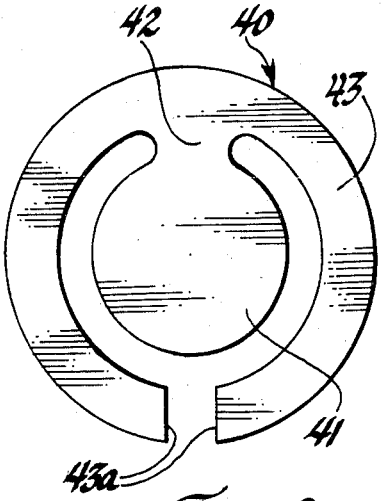

Referrig now to the flat reed valve 40 of the invention, this flat reed valve 40, made, for example, from a pre-hardened or hard rolled steel, as by being blanked in a progressive die stamping press, includes, as best seen in FIG. 2, a generally circular or part-circular tongue or flapper 41 with a relatively narrow spring leg 42 extending therefrom so as to merge at its other end into an outer split retainer ring 43. Thus as illustrated, the flapper 41 is connected by the spring leg 42 to the outer split retainer ring 43 at a location 180° from the center cut or slot between the free ends 43*a* of the latter. Preferably as shown, the opposite sides of the spring leg 42 are of arcuate configuration whereby opposite ends thereof blend smoothly into the flapper and split retainer ring 41 and 43, respectively.

The part-circular flapper 41, defining the actual port 24 control valve, has an effective external diameter substantially larger than the internal diameter of the outlet or lower end of port 24 so that when the flapper is in the position shown in FIG. 1 it will be seated against the flat shoulder 26 whereby to block fluid flow from the pressure chamber 30 out through port 24.

The split retainer ring 43 has an effective, as formed, outside diameter slighly greater than the internal diameter of the lower wall 25 of the plunger 20 next adjacent to the flat shoulder 26 whereby it is operative to serve as a retainer for the flat reed valve 40. It will now be appreciated that the, as formed, outside diameter of the split retainer ring 43 is preferably preselected relative to the radially inclined taper of lower wall 25 so as to permit insertion of the flat reed valve 40 into the free end of this lower wall 25 and then to be axially moved, upward with reference to FIG. 1, into abutment against the flat shoulder 26. As this occurs, the split retainer ring 43 will slightly collapse radially inward, the inclined surface of wall 25 serving as a cam surface so as to compress the outer edge of the split retainer ring 43 radially inward, so that when it is positioned as shown in FIG. 1, it will apply sufficient radial outward spring bias force against the inboard end of lower wall 25 adjacent to flat shoulder 26 so as to hold the flat reed valve 40 in unit assembly with in the plunger 20. Of course after assembly of the plunger 20 into the cylinder member 11, the plunger spring 31 will then assist in holding the flat reed valve 40 seated on the flat shoulder 26 against the pressure of fluid in the reservoir chamber 29. As shown, the upper end of the plunger spring 31 abuts only against the split retainer ring 43 as shown in FIG. 1.

Preferably, after assembly, the pressure chamber 30 of the roller hydraulic valve lifter 10 is filled with hydraulic fluid so that a usual leak-down test can be conducted so as to determine if the leak-down or flow from the pressure chamber 30 out through the conventional close tolerance leak-down flow path between the plunger 20 and cylinder member 11 is at predetermined limits. The roller hydraulic valve lifter 10 is then shipped to a customer for the usual installation in an engine with hydraulic fluid still in the pressure chamber 30.

Thereafter during engine operation, hydraulic fluid, such as engine oil under pressure, is then supplied to the reservoir chamber 29 and port 24. Assuming that the pressure chamber 30 is full of fluid, during each lift stroke of the cylinder member 11 by the cam 3, fluid is trapped in the pressure chamber 30, with this fluid acting on the underside of the flapper 41 to force it into seating engagement with the flat shoulder 26 so as to block port 24, and accordingly the plunger 20 is forced to travel upward, with reference to FIG. 1, with the cylinder member 11 carrying with it the push rod seat 32 and push rod 33. During each such cam 3 lift stroke, a small amount of fluid trapped in the pressure chamber 30 escapes out around the diametral clearance between the plunger 20 and cylinder member 11, which leakage is termed 'leak-down' and is necessary in order to insure that the associate poppet valve, not shown, may fully close on the subsequent return stroke, which occurs with the continued rotation of cam 3, as is well known in the art.

Of course, after the associated poppet valve, not shown, closes, the plunger spring 31 continues to bias the roller cam follower 14 on the cylinder member 11 in contact with the surface of cam 3 while holding the plunger 20 in abutment against the push rod seat 32 so as to take out all "lash" in the system. Thus while the cylinder member 11 via roller cam follower 14 is regaining its engagement with the usual base circle of the cam 3, the plunger 20 can therefore be moved axially outward of the cylinder member 11 to compensate for all or substantially all of its "leak-down? movement inwardly on the lift stroke. This plunger 20 outward movement thus results in re-enlarging the volume of the pressure chamber 30. As this occurs, the resulting fluid pressure differential across the flapper 41 will cause it to unseat from the flat shoulder 26 encircling port 24 to allow fluid flow from the reservoir chamber 29 side of the now unseated flapper 41 into the pressure chamber 30. In a particular roller hydraulic valve lifter 10 application, it has been found that the maximum valve lift of the flapper 41 at its free end is approxiamtely 0.1 mm, the split retainer ring 43 remaining flat as the flapper 41 moves between its open and closed positions.

Thus by appropriate selection of the thickness and hardness of the flat reed valve, the flapper 41 as connected by spring leg 42 to the split retainer ring 43 can be continuously flexed between valve open and closed positions without permanent deformation.

It has also been found that the flat reed valves 40 can be blanked in a progressive die stamping press into a flat as formed configuration at a rate in excess of 100 per minute without any additional finishing of these flat reed valves being required.

It should now also be apparent that in view of the configuration of the flat reed valve 40, it is a multidirectional valve since no angular orientation of this valve is required during its assembly into an associated plunger 20 and, of course the flat reed valve 40 can be inserted into the plunger 40 with either flat side thereof facing the flat shoulder 26, since both opposed surfaces of this reed valve 40 are flat.

While the invention has been described with reference to the structure disclosed herein, it is not confined to the specific details set forth, since it is apparent that many modifications and changes can be made by those skilled in the art. For example, the flat reed valve of the invention can be used in various types of hydraulic lash adjusters including self-contained hydraulic lash adjusters. This application is therefore intended to cover such modificiations or changes as may come within the purposes of the improvements or scope of the following claims.

The embodiments of the invention in which an exclusive property or privilege is claimed are defined as follows:

1. A hydraulic lash adjuster including a cup-shaped cylinder member with a closed end, a plunger, with a stepped bore therethrough, slidable in said cylinder member and defining with said closed end of said cylinder member a pressure chamber, said plunger defining therein a reservoir chamber and a port connected thereto arranged for flow communication with said pressure chamber, a plunger spring operatively located in said pressure chamber in position to normally bias said plunger outward relative to said cylinder member and, a one-way check valve operatively positioned by said plunger spring, said one-way check valve being normally operative to control flow through said port, and the improvement wherein said one-way check valve is in the form of a flat reed valve that includes a part-circular flapper, a split retainer ring extending about said flapper and having spaced apart free ends, and a spring leg integrally connecting said flapper to said split retainer ring centrally of and opposite said free ends, said split retainer ring being operative to operatively secure said flat reed valve within said stepped bore of said plunger to control flow through said port.

2. A hydraulic lash adjuster according to claim 1, wherein said stepped bore of said plunger at its end defining part of the pressure chamber defines a tapered internal wall terminating at a flat shoulder encirling said port which at its other end is in flow communication with the reservoir chamber, said split retainer ring of said flat reed valve having a nominal external diameter such that as positioned in said tapered internal wall against said flat shoulder said split retainer ring is biased into engagement with said tapered internal wall whereby to retain said flat reed valve within said plunger in flat abutment against said flat shoulder such that said part-circular flapper normally blocks said port.

* * * * *